US006701940B2

(12) United States Patent
Tsibouklis et al.

(10) Patent No.: US 6,701,940 B2
(45) Date of Patent: Mar. 9, 2004

(54) HARD SURFACE CLEANERS CONTAINING ETHYLENE OXIDE/PROPYLENE OXIDE BLOCK COPOLYMER SURFACTANTS

(75) Inventors: John Tsibouklis, Waterlooville (GB); Maureen J. Stone, Southampton (GB); Richard W. Avery, Bucks (GB)

(73) Assignee: S. C. Johnson & Son, Inc., Racine, WI (US)

( * ) Notice: Subject to any disclaimer, the term of this patent is extended or adjusted under 35 U.S.C. 154(b) by 58 days.

(21) Appl. No.: 09/975,318

(22) Filed: Oct. 11, 2001

(65) Prior Publication Data

US 2003/0096725 A1 May 22, 2003

(51) Int. Cl.[7] ..... B08B 3/04; C11D 1/722; C11D 3/37; C11D 3/43

(52) U.S. Cl. ..... 134/25.2; 134/38; 134/39; 134/40; 134/42; 510/238; 510/239; 510/240; 510/362; 510/365; 510/384; 510/386; 510/391; 510/421; 510/475

(58) Field of Search ..... 510/238–240, 510/362, 365, 384, 386, 391, 421, 475; 134/25.2, 38, 39, 40, 42

(56) References Cited

U.S. PATENT DOCUMENTS

| | | | | | |
|---|---|---|---|---|---|
| 3,882,036 | A | | 5/1975 | Krezanoski et al. | 252/106 |
| 3,959,176 | A | | 5/1976 | Mahn et al. | 252/352 |
| 4,105,574 | A | * | 8/1978 | Culmone et al. | 252/154 |
| 4,247,408 | A | | 1/1981 | Imamura et al. | 252/143 |
| 4,285,840 | A | | 8/1981 | Fricker | 252/546 |
| 4,539,145 | A | | 9/1985 | Alvarez et al. | 252/542 |
| 4,766,030 | A | | 8/1988 | Hervey | 428/289 |
| 4,836,948 | A | | 6/1989 | Corring | 252/99 |
| 4,911,858 | A | | 3/1990 | Bunczk et al. | 252/106 |
| 4,959,170 | A | | 9/1990 | Ulrich et al. | 252/135 |
| 5,030,280 | A | | 7/1991 | Hoefer et al. | 106/13 |
| 5,049,299 | A | | 9/1991 | Bunczk et al. | 252/106 |
| 5,091,102 | A | | 2/1992 | Sheridan | 252/91 |
| 5,114,607 | A | | 5/1992 | Deck et al. | 252/156 |
| 5,126,068 | A | | 6/1992 | Burke et al. | 252/174.21 |
| 5,141,803 | A | | 8/1992 | Pregozen | 428/288 |
| 5,169,552 | A | | 12/1992 | Wise | 252/95 |
| 5,180,749 | A | * | 1/1993 | Cusack et al. | 514/726 |
| 5,188,755 | A | * | 2/1993 | Chang | 252/174 |
| 5,286,300 | A | | 2/1994 | Hnatin et al. | 134/2 |
| 5,358,653 | A | * | 10/1994 | Gladfelter et al. | 252/90 |
| 5,411,585 | A | * | 5/1995 | Avery et al. | 106/287.1 |
| 5,589,099 | A | | 12/1996 | Baum | 510/514 |
| 5,691,292 | A | | 11/1997 | Marshall et al. | 510/221 |
| 5,707,553 | A | | 1/1998 | Sawyer et al. | 252/392 |
| 5,756,439 | A | * | 5/1998 | He et al. | 510/159 |
| 5,780,417 | A | * | 7/1998 | Gorlin | 510/426 |
| 5,858,279 | A | | 1/1999 | Lunski et al. | 252/321 |
| 5,911,915 | A | * | 6/1999 | Fonsny et al. | 252/312 |
| 5,962,388 | A | | 10/1999 | Sherry et al. | 510/238 |
| 5,990,066 | A | | 11/1999 | Gordon et al. | 510/238 |
| 5,997,621 | A | | 12/1999 | Scholz et al. | 106/13 |
| 6,017,869 | A | | 1/2000 | Lu et al. | 510/384 |
| 6,025,314 | A | | 2/2000 | Nitsch et al. | 510/221 |
| 6,039,965 | A | | 3/2000 | Donlan et al. | 424/405 |
| 6,076,229 | A | | 6/2000 | Berglund | 15/321 |

FOREIGN PATENT DOCUMENTS

| | | | |
|---|---|---|---|
| EP | 0222557 A2 | 5/1987 | C11D/17/00 |
| EP | 0590722 A2 | 4/1994 | C11D/1/72 |
| WO | WO 95/01414 | 1/1995 | C11D/3/00 |

OTHER PUBLICATIONS

Technical Bulletin, "PLURONIC F127 Block Copolymer Surfactant Product Literature", BASF Corporation, 1 page, no date given.*

Technical Bulletin, "PLURONIC F108 Block Copolymer Surfactant Product Literature", BASF Corporation, 1 page, no date given.*

Technical Bulletin, "PLURONIC L43 Block Copolymer Surfactant Product Literature", BASF Corporation, 1 page, no date given.*

Technical Bulletin, "PLURONIC 25R8 Block Copolymer Surfactant Product Literature", BASF Corporation, 3 pages, no date given.*

* cited by examiner

*Primary Examiner*—Brian P. Mruk

(57) ABSTRACT

Disclosed herein are hard surface antimicrobial cleaners and methods for using them. The cleaners include a low concentration of high molecular weight ethylene oxide/propylene oxide block copolymer and a carrier. This provides residual benefits on the hard surface such as soil resistance and resistance to bacteria, molds, and biofilms. The cleaners contain other surfactants, and preferably also water and an organic acid.

17 Claims, No Drawings

HARD SURFACE CLEANERS CONTAINING ETHYLENE OXIDE/PROPYLENE OXIDE BLOCK COPOLYMER SURFACTANTS

CROSS-REFERENCE TO RELATED APPLICATION

Not applicable.

STATEMENT REGARDING FEDERALLY SPONSORED RESEARCH/DEVELOPMENT

Not applicable.

BACKGROUND OF THE INVENTION

The present invention relates to cleaning compositions for hard surfaces. They appear to be especially well suited for use in cleaning toilet bowls, baths, shower surrounds and other plumbing fixtures, bathroom and kitchen hard surfaces, glass windows, and floor surfaces. The cleaning compositions of the present invention render treated or cleaned surfaces hydrophilic and provide such surfaces with excellent anti-fogging properties. Such surfaces treated or cleaned with the compositions of the present invention also resist soiling and colonization by bacteria and fungi, and resist the formation of biofilms.

Products sold under the trademark "PLURONIC" by BASF are a series of one type of closely related block copolymers that may be generically classified as polyoxypropylene-polyoxyethylene condensates terminating in primary hydroxy groups. Such block copolymers are nonionic surfactants and have been used for a wide variety of applications. Block copolymers may also be functionalized (the terminal alcohol converted to an ether) with fatty alcohols, especially primary alcohols having 8–20 carbons. Such block copolymers (also referred to as block copolymers capped with fatty alcohols) are, for example, sold under the trademark "DEHYPON" and are available from Cognis Corporation.

The art has developed a variety of cleaning and/or treating compositions, including some containing block copolymers (or capped derivatives thereof). For example, U.S. Pat. Nos. 5,589,099 and 6,025,314 disclose rinse aid compositions containing such block copolymers where they are employed in dishwashing processes. The disclosure of these patents and all other patents described herein are incorporated by reference as if fully set forth herein. Also, U.S. Pat. No. 5,286,300 teaches that such block copolymers can be used in rinse aid composition for metal surfaces. Further, these block copolymers have utility as nonionic surfactants in halophor-containing cleaning compositions (U.S. Pat. Nos. 5,049,299 and 5,169,552); in contact lens cleaning and storing compositions (U.S. Pat. No. 3,882,036); in compositions for treating plastic surfaces to prevent fogging (U.S. Pat. No. 5,030,280); as a defoamer or low foaming detergent (U.S. Pat. Nos. 5,691,292 and 5,858,279); as a plasticizer in a solid cake cleansing block composition for toilets (U.S. Pat. No. 4,911,858); as a surfactant in organosilane solutions (U.S. Pat. No. 5,411,585); and as a surfactant for reducing bacterial adhesion on surfaces in contact with industrial water systems such as process or cooling water systems (U.S. Pat. No. 6,039,965).

The art has also developed a variety of hard surface cleaning compositions. For example, U.S. Pat. No. 5,990,066 teaches a surface cleaning composition that contains block copolymer surfactants, a carboxylate-containing polymer, and a divalent counterion. The block copolymer is said to provide a gloss benefit to the cleaned surface. Also, U.S. Pat. No. 4,247,408 discloses a hard surface cleaning composition containing a polyoxyalkylene alkyl ether solvent, an acidic substance, and a nonionic surfactant which may be block copolymers.

U.S. Pat. No. 4,539,145 discloses an outside window cleaner containing polyvinyl alcohol and an amine-containing polymer which may also include a nonionic surfactant such as a block copolymer. The block copolymer is said to improve the detergency of the composition. U.S. Pat. No. 5,126,068 also teaches a hard surface cleaning composition containing organic solvents and water, polycarboxylate copolymers, pH adjusters, and certain block copolymer surfactants. It is said that this composition is particularly useful in glass cleaners and that it is substantially streak-free when applied to glossy or transparent surfaces.

While these varied prior art compositions have provided a variety of ways to treat and/or clean hard surfaces, they have been limited in their ability to provide residual benefits to such surfaces. In this regard, it is desirable to render hard surfaces that are being cleaned more resistant to becoming soiled, and especially to provide the surface with antimicrobial characteristics such as resistance to colonization by bacteria, fungi, and biofilms. Thus, there is a continuing need to develop hard surface cleaners which not only are effective in cleaning at the time of use, but also provide positive residual benefits to the surface that has been cleaned.

BRIEF SUMMARY OF THE INVENTION

The compositions of the present invention unexpectedly address this need by utilizing block copolymers at low concentrations, such block copolymers having a high average molecular weight.

In one aspect the invention provides a hard surface antimicrobial cleaner. It has one or more surfactants, one of which must be a polyoxyethylene/polyoxypropylene block copolymer (e.g. with a terminal hydroxyl, or where the terminal hydroxyl is functionalized with a fatty alcohol). Preferably, the block copolymer is from 0.2–5% by weight of the composition.

For example, it has been found that a level of from 0.2% to 4% by weight of "PLURONIC F127" provides excellent hydrophilic and anti-fog benefits to treated glass surfaces. Such benefits are also provided to treated polymethyl methacrylate and other plastic surfaces, but at a higher preferred level of from 1.5% to 5% by weight of "PLURONIC F127".

Normally the cleaner will also contain water (preferably more than 50% of the cleaner even more preferably over 90% of the cleaner), and there may be an acid. The cleaners can include a wide variety of surfactants such as nonionic, anionic, cationic and amphoteric surfactants, and mixtures thereof. Examples of such surfactants are described in McCutcheon's: *Emulsifiers & Detergents*, North American Edition (1995).

Suitable nonionic surfactants include alkyl amine oxides (e.g., $C_{8-20}$ alkyl dimethyl amine oxides), alkylphenol ethoxylates, linear and branched alcohol ethoxylates, carboxylic acid esters, alkanolmides, alkylpolyglycosides, ethylene oxide/propylene oxide copolymers, and the like. Especially preferred among these are linear and secondary alcohol ethoxylates, octyl- and nonyl-phenol ethoxylates, alkanol amides and alkylpolyglycosides.

Useful zwitterionic/amphoteric surfactants include alkyl aminopropionic acids, alkyl iminopropionic acids, imidiazoline carboxylates, alkylbetaines, sulfobetaines, and sultaines.

Useful cationic surfactants include, for example, primary amine salts, diamine salts, quaternary ammonium salts, and ethoxylated amines.

Useful anionic surfactants (which are preferably used only in conjunction with a nonionic surfactant, if at all) include carboxylic acid salts, alkyl benzene sulfonates, secondary n-alkane sulfonates, alpha-olefin sulfonates, dialkyl diphenylene oxide sulfonates, sulfosuccinate esters, isoethionates, linear alcohol sulfates (alkyl sulfates such as sodium lauryl sulfate), and linear alcohol ethoxy sulfates.

In certain embodiments of the claimed hard surface cleaner, an acid may be included in the composition. Preferred acids are organic acids such as lactic acid, sulfamic acid, citric acid, valeric acid, hexanoic acid, and glycolic acid. Other examples are formic acid, acetic acid, propionic acid, butyric acid, and gluconic acid, and peroxy variants of these acids such as peroxyacetic acid. The acid is preferably less than 10% by weight of the cleaner, even more preferably less than 5% of the cleaner. A preferred pH range for the cleaner when the cleaner is an aqueous solution is 5–11.

There may also be a glycol ether solvent (most preferably ethylene glycol hexyl ether or ethylene glycol butyl ether). This is particularly desirable for kitchen and window cleaners where there is substantial grease that needs to be cleaned. Other possible solvents are terpenes, aliphatic hydrocarbons and alpha-olefins, and organic compounds containing at least one oxygen atom, such as alcohols and ethers. For example, isopropanol is particularly useful as a solvent in the window cleaner compositions of the present invention.

Among these oxygen-containing solvents are aliphatic alcohols of up to 8 carbon atoms, particularly tertiary alcohols of up to 8 carbon atoms; aromatic-substituted alcohols; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbon atoms in each alkyl group; mono- or diesters of alkylene glycols or polyalkylene glycols having up to 6 carbon atoms per glycol group and up to 6 carbon atoms in each ester group.

Specific examples of solvents include t- butanol, t-pentyl alcohol; 2,3-dimethyl-2-butanol, benzyl alcohol or 2-phenyl ethanol, ethylene glycol, propylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, and dipropylene glycol monoacetate.

The solvent preferably constitutes no more than 6 weight percent of the composition, more preferably no more than 2 weight percent.

Also, particularly with respect to window cleaners, it may be desirable to include ammonia in the form of ammonium hydroxide to enhance cleaning and raise the pH.

For some applications such as toilet bowl cleaners and bathroom wall cleaners it is particularly desirable that the cleaner also contain a cellulosic thickener. A preferred thickener is hydroxyethyl cellulose. It is preferably present in under 5% by weight of the cleaner. Other suitable cellulosic thickeners include carboxy methyl cellulose, hydroxypropyl cellulose, xantham gums and derivatives, guar gums and derivatives, acrylic thickeners, urethane thickeners, cationic thickeners, such as polyacrylamide types, and clay thickeners, such as bentone or attapulgites.

If desired a disinfectant can be used (preferably benzalkonium chloride). Other possible disinfectants include polyhexamethylene biguanide, phenolic disinfectants, amphoteric disinfectants, anionic disinfectants, and metallic disinfectants (e.g. silver).

The cleaning compositions of the present invention may also include colors and/or fragrances. Such colors and fragrances are well known to those skilled in the art of cleaning compositions.

In another form, the invention provides a method of cleaning a hard surface. A standard means of treatment is to apply a cleaner of the above kind against the hard surface (e.g., by spraying), rubbing or scraping the cleaner against the surface, rinsing the surface with water until no more cleaner is visible to the eye, and then lightly wiping the surface until standing water is removed.

By "hard surface" we mean a solid, substantially non-flexible, surface such as a counterion, bathroom tile, plumbing fixture wall, bathroom or kitchen wall, glass window, or linoleum floor. It does not include fabric, carpet, hair, skin, or other softer materials which are highly flexible.

It has been surprisingly learned that the addition of certain block copolymers to a hard surface cleaner causes surfaces that have been cleaned using the cleaner to be left with residual benefits. In particular, the surfaces resist soiling, are easier to clean when stained, and provide resistant to bacteria, fungi, and biofilms. These benefits have been achieved without disrupting the cleaning function of the cleaner.

For purposes of this application, "antimicrobial" shall mean providing more resistance to the growth of at least one bacteria after such a treatment, where the effect is at least in part due to the block copolymer (and not just other disinfectants which may also be present).

The block copolymers useful in the compositions and methods of the present invention may be selected from, for example, block copolymers including first and second blocks of repeating ethylene oxide (EO) units and a block of propylene oxide (PO) units interposed between said first and second blocks of repeating ethylene oxide units. Such block copolymers may have the general structure (I):

$$HO-(CH_2CH_2O)_x-(CH_2\overset{\overset{CH_3}{|}}{C}HO)_y-(CH_2CH_2O)_z-H \quad (I)$$

wherein x is 0 to 1,000, y is 1 to 1,000, and z is 0 to 1,000, with the proviso that x and z are not both 0. The block copolymers of the above structure (I) preferably have a ratio of ethylene oxide (EO) units to propylene oxide (PO) units of from 1:10 to 10:1; most preferably from 4:6 to 6:4. The preferred average molecular weight of the block copolymer of structure (I) is from 285 to 100,000; more preferred is from 2,000 to 40,000; most preferred is from 8,000 to 20,000.

Additional examples of block copolymers useful in the compositions and methods of the present invention include those wherein the copolymers include first and second blocks of repeating propylene oxide (PO) units and a block of repeating ethylene oxide (EO) units interposed between first and second blocks of repeating propylene units. Such block copolymers may have the general structure (II):

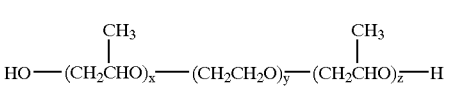

(II)

wherein x is 0 to 1,000, y is 1 to 1,000, and z is 0 to 1,000, with the proviso that x and z are not both 0. The block copolymers of the above structure (II) preferably have a ratio of EO units to PO units of from 1:10 to 10:1; most preferably from 4:6 to 6:4. The preferred average molecular weight of the block copolymer of structure (II) is from 280 to 100,000; more preferred is from 2,000 to 40,000; most preferred is from 8,000 to 20,000.

The block copolymers of structures (I) and (II) are available from BASF and are sold under the trademark "PLURONIC". PLURONIC F127 has a structure according to that shown in structure (I) with x being about 99, y being about 67, and z being about 99. PLURONIC F127 has an average molecular weight of about 12,600.

Other useful EO/PO block copolymers are those block copolymers shown in structures (I) and (II) functionalized/capped with fatty alcohols. Such functionalized block copolymers are attractive because they are more biodegradable than the block copolymers shown in structures (I) and (II). By fatty alcohols we mean linear or branched, saturated or unsaturated primary alcohols having 8-20 carbons. Such functionalized block copolymers are disclosed in U.S. Pat. Nos. 5,030,280; 5,411,585; and 6,025,314. Preferably such block copolymers are functionalized with fatty alcohols having 12–14 carbons.

The preferred ratio of EO to PO units of such block copolymers functionalized with fatty alcohols is as set forth above for structures (I) and (II). The preferred average molecular weight for these functionalized block copolymers is as set forth above for structures (I) and (II), except that the average molecular weights are adjusted to account for the average molecular weight of the fatty alcohol used to functionalize the block copolymer. These capped block copolymers are available from Cognis Corporation and are sold under the trademark "DEHYPON". Two preferred block copolymers are DEHYPON LS54 and DEHYPON LS34 which have EO to PO unit ratios of 5:4 and 3:4, respectively. DEHYPON LS54 is especially preferred.

Generally, the compositions of the present invention should contain about 2% of the block copolymer to confer good anti-fogging performance to the treated surface. Particularly surprising, we found that good anti-fogging performance can be conferred to treated surfaces using compositions having as little as 0.25% of the fatty alcohol functionalized block copolymers (e.g. DEHYPON LS54). It was also unexpected that compositions containing as little as 2% of the functionalized block copolymers had the ability to impart resistance to bacterial colonization on the treated surface given the biodegradability of such compounds.

The foregoing and other advantages of the invention will appear from the following description. In that description reference is made to the accompanying drawing which forms the part hereof. These embodiments do not represent the full scope of the invention. Thus, the claims should be looked to in order to judge the full scope of the invention.

DETAILED DESCRIPTION OF THE PREFERRED EMBODIMENTS

Preferred examples of the present invention are described below. The first five are two toilet bowl cleaners, a bath and shower cleaner, a kitchen cleaner, and a window cleaner.

EXAMPLE 1

Toilet Bowl Cleaner

| Weight percent | Description | Chemical name |
|---|---|---|
| To 100 | Carrier | Water |
| 2.00 | PLURONIC F127 | EO/PO Block Copolymer |
| 2.50 | Acid | Lactic or glycolic acid |
| — | Thickener | Hydroxyethyl cellulose |
| — | Color | Color |
| — | Fragrance | Fragrance |

EXAMPLE 2

Toilet Bowl Cleaner

| Weight percent | Description | Chemical name |
|---|---|---|
| To 100 | Carrier | Water |
| 1.00 | Nonionic surfactant | Alcohol ethoxylate |
| 2.00 | PLURONIC F127 | EO/PO Block Copolymer |
| 0.50 | Acid | Sulfamic acid |
| 0.50 | Disinfectant | Benzalkonium chloride |
| — | Thickener | Hydroxyethyl cellulose |
| — | Color | Color |
| — | Fragrance | Fragrance |

EXAMPLE 3

Bath and Shower Cleaner

| Weight percent | Description | Chemical name |
|---|---|---|
| To 100 | Carrier | Water |
| 0.50 | Nonionic Surfactant | Polyglucoside |
| 0.50 | Acid | Citric Acid |
| 0.50 | Acid | Lactic Acid |
| 0.50 | PLURONIC F127 | EO/PO Block Copolymer |
| 0.20 | Disinfectant | Benzalkonium chloride |
| — | Thickener | Cellulose derivative |
| — | Color | Color |
| — | Fragrance | Fragrance |

EXAMPLE 4

Kitchen Cleaner

| Weight percent | Description | Chemical name |
|---|---|---|
| To 100 | Carrier | Water |
| 1.00 | Acid | Glycolic Acid |
| 0.50 | DEHYPON LS-54 | EO/PO Block Copolymer |
| 0.30 | Nonionic surfactant | Amine Oxide |
| 0.75 | Nonionic surfactant | Polyglucoside |
| 0.57 | Solvent | Ethylene glycol butyl ether |
| 0.43 | Solvent | Ethylene glycol hexyl ether |
| 0.10 | Disinfectant | Benzalkonium chloride |
| — | Fragrance | Fragrance |

EXAMPLE 5

Window Cleaner

| Weight percent | Description | Chemical name |
|---|---|---|
| To 100 | Carrier | Water |
| 3.50 | Solvent | Isopropanol |
| 1.00 | Cleaner/pH modifier | Ammonium hydroxide |
| 0.50 | PLURONIC F127 | EO/PO Block Copolymer |
| 0.33 | Anionic surfactant | Sodium lauryl sulfate (30%) |
| 0.80 | Solvent | Ethylene glycol butyl ether |
| 0.60 | Solvent | Ethylene glycol hexyl ether |
| — | Fragrance | Fragrance |

Method of Forming Preferred Embodiments

The above cleaners can be formulated by adding the components to water and then mixing at room temperature.

Testing

EXAMPLE 6

Antifogging Tests

Comparative tests undertaken to demonstrate the enhanced cleaning and antifogging effect of a formulation containing a block copolymer of the present invention against conventional cleaning formulations.

| Conventional formulation: | |
|---|---|
| Soft water | 94.124% |
| Isopropanol | 3.500% |
| Ethylene glycol monobutyl ether | 0.800% |
| Ethylene glycol n-hexyl ether | 0.600% |
| Ammonia solution (25%) | 0.300% |
| Propylene glycol | 0.250% |
| Monoethanolamine | 0.200% |
| Decy (sulphenoxy) benzene sulphonic acid-disodium salt | 0.150% |
| Fragrance | 0.050% |
| Direct blue 86 | 0.001% |

Block Copolymer Formulation

As above plus 2.0% of PLURONIC F127.

Mirrors treated (with the aforesaid standard treatment) with the block copolymer and conventional formulations were placed over a steaming water bath for periods of up to 15 minutes and the surface continually monitored for areas of fogging. Mirrors treated with the conventional formulation became completely fogged within 2 minutes. However, mirrors treated with the formulation containing PLURONIC F127 remained completely clear for extended periods of time, retaining good reflective qualities.

EXAMPLE 7

Microbiological Tests

Studies were performed to investigate the extent of bacterial colonization on glazed stoneware that had been treated using the above standard treatment with an aqueous toilet-bowl-cleaner formulation incorporating 2% PLURONIC F127 (e.g. Examples 1 and 2). Glazed stoneware tiles washed with the above aqueous formulation were immersed (24 hours) in nutrient broth inoculated with *E. coli*. Microscopic examination of the tiles (after exposure to the bacterial cultures) revealed a marked reduction in the extent of bacterial colonization on the surfaces of the tiles treated with the Examples 1 and 2 formulations as compared to tiles treated with a conventional commercially-available formulation.

Thus, the present invention provides effective cleaners that not only clean hard surfaces, but also leave desirable residual properties on the surfaces after the cleaning. While the preferred embodiments incorporate various terminal hydroxy block copolymers, other block copolymers (e.g., functionalized or capped block polymers) can be used.

Thus, while specific embodiments have been described, various modifications within the breadth and scope of the invention may be made. The following claims should be looked to in order to understand the full scope of the invention.

INDUSTRIAL APPLICABILITY

The present invention provides improved hard surface cleaners.

We claim:

1. A hard surface antimicrobial cleaner, comprising:

an ethylene oxide/propylene oxide block copolymer having an average molecular weight of at least 8,000 and being from 0.2% to 5% by weight of the cleaner;

an organic acid selected from the group consisting of lactic acid, sulfamic acid, citric acid, valeric acid, hexanoic acid, and glycolic acid, wherein the organic acid is present, but in an amount less than 5 percent by weight of the cleaner; and water present in an amount that is more than 50% of the cleaner.

2. The hard surface antimicrobial cleaner of claim 1, wherein the block copolymer is from 0.2% to 4% by weight of the cleaner.

3. The hard surface antimicrobial cleaner of claim 1, wherein the block copolymer is from 1.5% to 5% by weight of the cleaner.

4. The hard surface antimicrobial cleaner of claim 1, wherein the block copolymer has the following structure:

$$HO-(CH_2CH_2O)_x-(CH_2\overset{\overset{CH_3}{|}}{C}HO)_y-(CH_2CH_2O)_z-H$$

wherein x is 0 to 1,000, y is 1 to 1,000, and z is 0 to 1,000, with the proviso that x and z are not both 0 and that x, y, and z are chosen such that the average molecular weight of the block copolymer is at least 8,000.

5. The hard surface antimicrobial cleaner of claim 4, wherein the average molecular weight of the block copolymer is 8,000 to 20,000 and the ratio of ethylene oxide units to propylene oxide units is from 1:10 to 10:1.

6. The hard surface antimicrobial cleaner of claim 1, further comprising no more than 6% by weight of a solvent system which comprises a glycol ether solvent.

7. The hard surface antimicrobial cleaner of claim 1, further comprising a nonionic surfactant.

8. The hard surface antimicrobial cleaner of claim 1, further comprising a cellulosic thickener.

9. The hard surface antimicrobial cleaner of claim 1, further comprising a disinfectant.

10. The hard surface antimicrobial cleaner of claim 6, further comprising an anionic surfactant.

11. The hard surface cleaner of claim 1, wherein the cleaner further comprises a solvent system comprising a glycol ether solvent.

12. A hard surface antimicrobial cleaner, comprising:

an ethylene oxide/propylene oxide block copolymer having an average molecular weight of at least 8,000 and being from 0.2% to 5% by weight of the cleaner;

0 to less than 10% by weight of an organic acid selected from the group consisting of lactic acid, sulfamic acid, citric acid, valeric acid, hexanoic acid, and glycolic acid;

no more than 6% by weight of a solvent system comprising isopropanol when no organic acid is present;

ammonium hydroxide when no organic acid is present; and a carrier;

wherein the block copolyrner is functionalized with a fatty alcohol ether moiety.

13. A hard surface antimicrobial cleaner, comprising:

an ethylene oxide/propylene oxide block copolymer having an average molecular weight of at least 8,000 and being from 0.2% to 5% by weight of the cleaner;

0 to less than 10% by weight of an organic acid selected from the group consisting of lactic acid, sulfamic acid, citric acid, valeric acid, hexanoic acid, and glycolic acid;

no more than 6% by weight of a solvent system comprising isopropanol when no organic acid is present;

ammonium hydroxide when no organic acid is present; and a carrier;

wherein the block copolymer has the following structure:

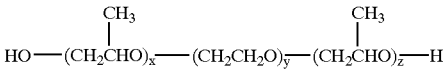

wherein x is 0 to 1,000, y is 1 to 1,000, and z is 0 to 1,000, with the proviso that x and z are not both 0 and that x, y, and z are chosen such that the average molecular weight of the block copolymer is at least 8,000.

14. The hard surface antimicrobial cleaner of claim 13, wherein the average molecular weight of the block copolymer is 8,000 to 20,000 and the ratio of ethylene oxide units to propylene oxide units is from 1:10 to 10:1.

15. A method of cleaning a hard surface, comprising:

applying the cleaner of claim 1 against a hard surface; and then rinsing the surface with water and/or wiping the surface.

16. A method of cleaning a hard surface comprising:

applying the cleaner of claim 14 against a hard surface; and then rinsing the surface with water and/or wiping the surface.

17. A method of cleaning a hard surface, comprising:

applying the cleaner of claim 11 against a hard surface; and then rinsing the surface with water and/or wiping the surface.

* * * * *